US009144701B2

(12) United States Patent
Chen

(10) Patent No.: US 9,144,701 B2
(45) Date of Patent: Sep. 29, 2015

(54) EXERCISE EQUIPMENT

(71) Applicant: Ming-Chin Chen, Changhua (TW)

(72) Inventor: Ming-Chin Chen, Changhua (TW)

(73) Assignee: Ever Gym Enterprises Co. Ltd., Changhua (TW)

( * ) Notice: Subject to any disclaimer, the term of this patent is extended or adjusted under 35 U.S.C. 154(b) by 108 days.

(21) Appl. No.: 13/932,247

(22) Filed: Jul. 1, 2013

(65) Prior Publication Data

US 2015/0005146 A1 Jan. 1, 2015

(51) Int. Cl.
*A63B 21/00* (2006.01)
*A63B 26/00* (2006.01)

(52) U.S. Cl.
CPC ..... *A63B 21/00047* (2013.01); *A63B 26/003* (2013.01)

(58) Field of Classification Search
CPC ..... A63B 21/00
USPC ..... 482/142
See application file for complete search history.

(56) References Cited

U.S. PATENT DOCUMENTS

| | | | | | |
|---|---|---|---|---|---|
| 4,955,914 | A | * | 9/1990 | Caniglia et al. | 606/235 |
| D463,952 | S | * | 10/2002 | Zemel | D7/393 |
| D647,980 | S | * | 11/2011 | Davis et al. | D21/662 |
| D693,934 | S | * | 11/2013 | Lin | D24/215 |
| D713,650 | S | * | 9/2014 | Sasson | D6/520 |

* cited by examiner

*Primary Examiner* — Jerome w Donnelly
(74) *Attorney, Agent, or Firm* — Che-Yang Chen; Law Office of Michael Chen

(57) ABSTRACT

An exercise equipment comprising: a column body that is hollow and has a plurality of engaging ribs protruding at outer surface of the column body. One end of the column body has a U-shaped handle that has two through holes on both sides of the column body corresponding to the engaging ribs of the column body, so that the handle is able to conjugate the engaging ribs at the outer surface of the column body through the through holes. A cover layer covers outer surface of the column body, wherein inner surface of the cover layer has recessed slots corresponding to the engaging ribs, so that the cover layer can tightly cover the outer surface of the column body through the engagement of the engaging ribs and the recessed slots to avoid sliding and misalignment between the column body and the cover layer.

9 Claims, 10 Drawing Sheets

EXERCISE EQUIPMENT

FIELD OF THE INVENTION

This invention relates to an exercise equipment, and more particularly to an exercise equipment with column structure.

BACKGROUND OF THE INVENTION

In general, various auxiliary aids and assistive devices are often needed in yoga, aerobics exercise or balance exercise to stretch exerciser's muscles. Among the auxiliary aids and assistive devices, rods and column structure are most widely used, as shown in FIGS. 9 and 10. The column structure mainly has a column body (40) and buffer foam (41) covered outer surface of the column body (40) to absorb the impact force generated by the rolling column body (40). However, conventional column structure has the following drawbacks: when the column body (40) and buffer foam (41) are conjugated together, the buffer foam (41) is glued on the column body (40) or squeezed onto the column body (40), so that there is no structure to position of the buffer foam (41) and the column body (40), which will easily cause sliding and misalignment when the column body (40) is rolling. Thus, there remains a need for a new and improved exercise column structure to overcome the problems above.

SUMMARY OF THE INVENTION

The technical problem the present invention wants to solve is that when the column body and buffer foam are conjugated together, the buffer foam is either glued on the column body or squeezed onto the column body, so that there is no structure to position of the buffer foam and the column body, which will easily cause sliding and misalignment when the column body is rolling.

The present invention provides an exercise equipment may include a column body, which is hollow and has a plurality of engaging ribs protruding at outer surface thereof. A cover layer covers outer surface of the column body, and the cover layer can be made by plastic injection or high-density foam. Inner surface of the cover layer has recessed slots corresponding to the engaging ribs, so that the cover layer can tightly cover the outer surface of the column body through the engagement of the engaging ribs and the recessed slots to avoid sliding and misalignment between the column body and the cover layer. Furthermore, in addition to the engaging ribs, the outer surface of the column body also has a plurality of auxiliary protruding ribs and auxiliary recessed slots to form the structure of the exercise equipment in the present invention.

Comparing with the prior arts, the present invention is advantageous because (i) the column body has a plurality of engaging ribs protruding at outer surface thereof and the cover layer covers outer surface of the column body. Inner surface of the cover layer has recessed slots corresponding to the engaging ribs, so that the cover layer can tightly cover the outer surface of the column body through the engagement of the engaging ribs and the recessed slots to avoid sliding and misalignment between the column body and the cover layer; and (ii) one end of the column body has the connecting portion to connect different column bodies to increase the variability thereof.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
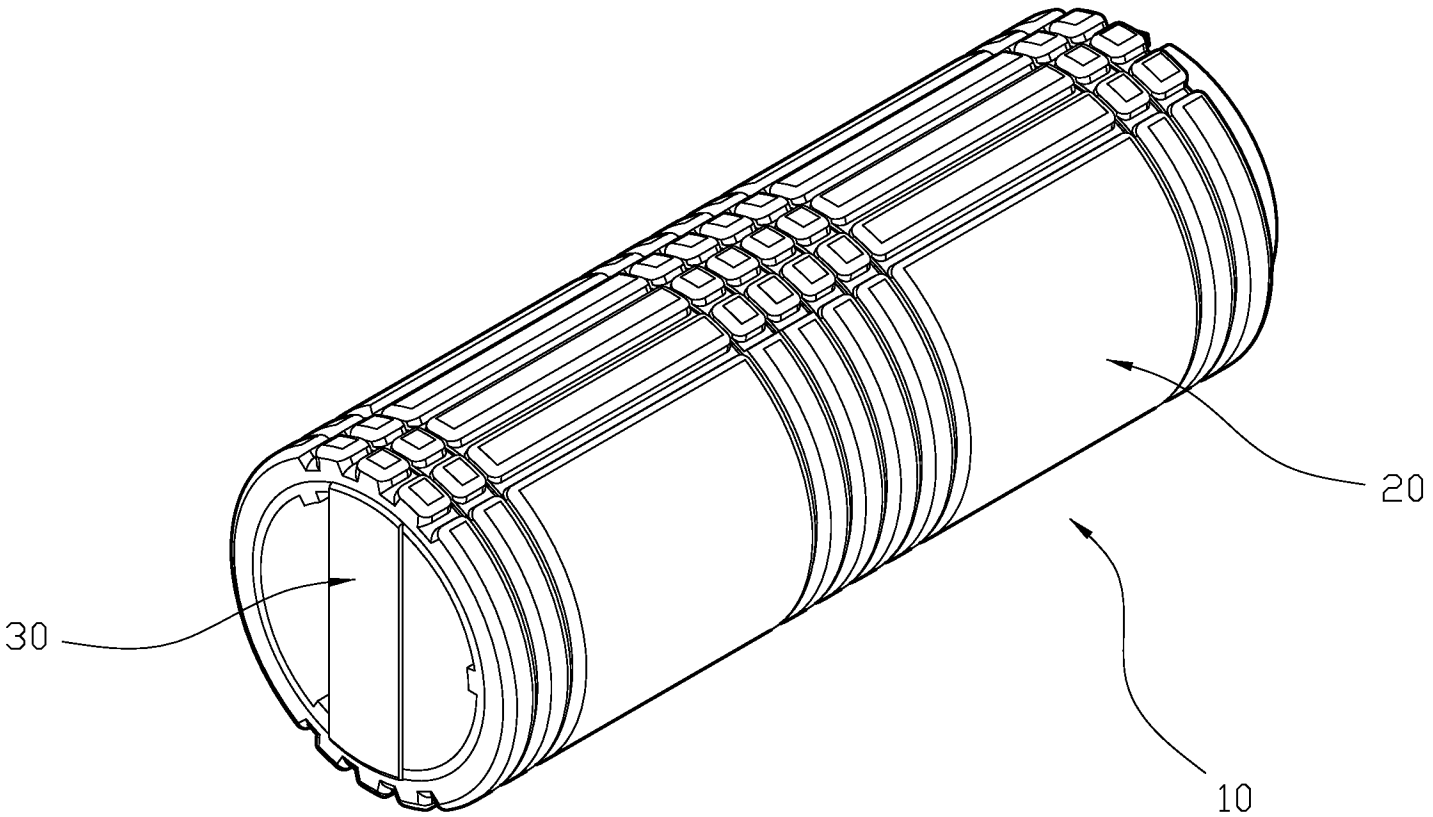
FIG. 1 illustrates a three-dimensional view of the present invention.
Figure 2:
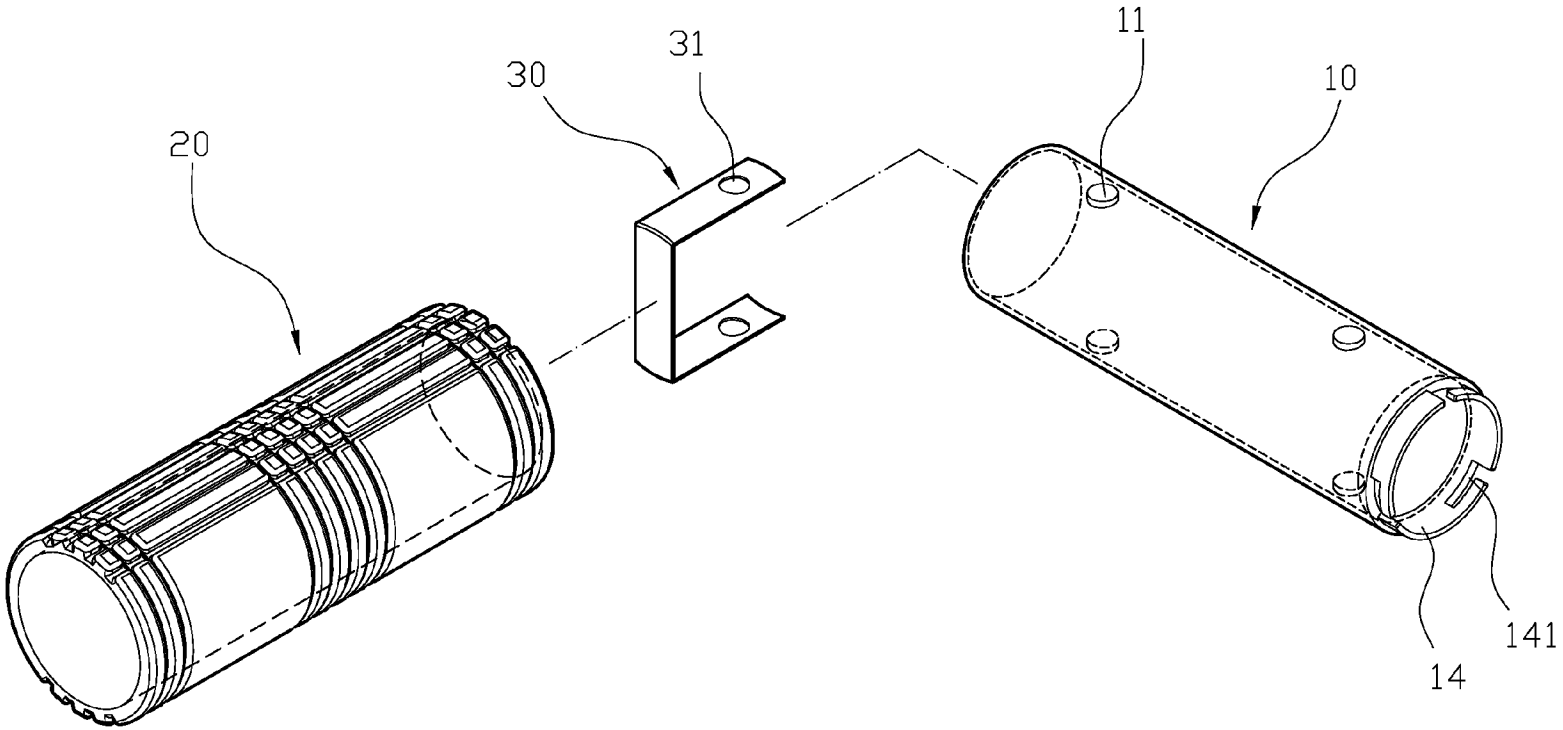
FIG. 2 illustrates an exploded view of the present invention.
Figure 3:
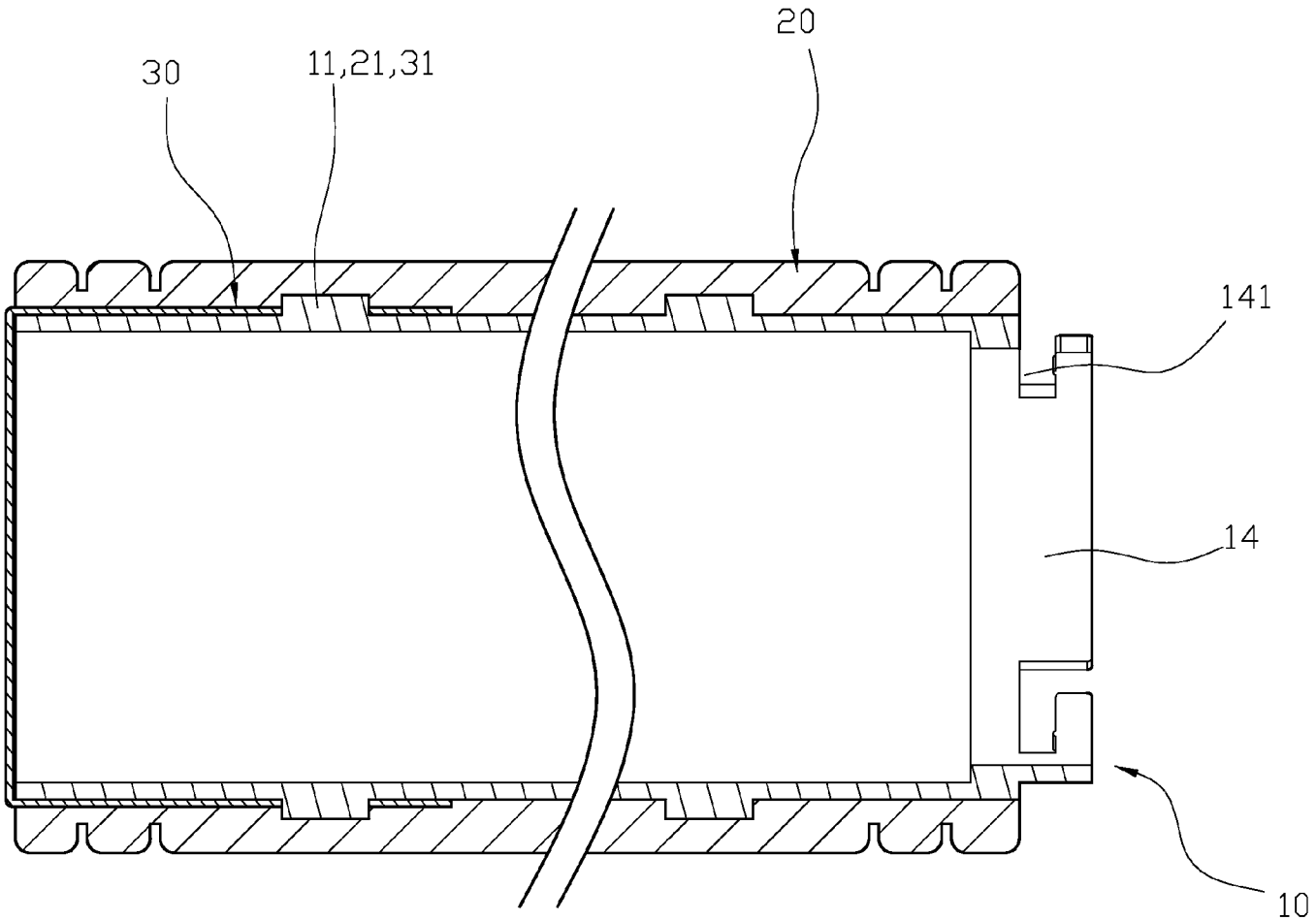
FIG. 3 illustrates a sectional view of the present invention.
Figure 4:
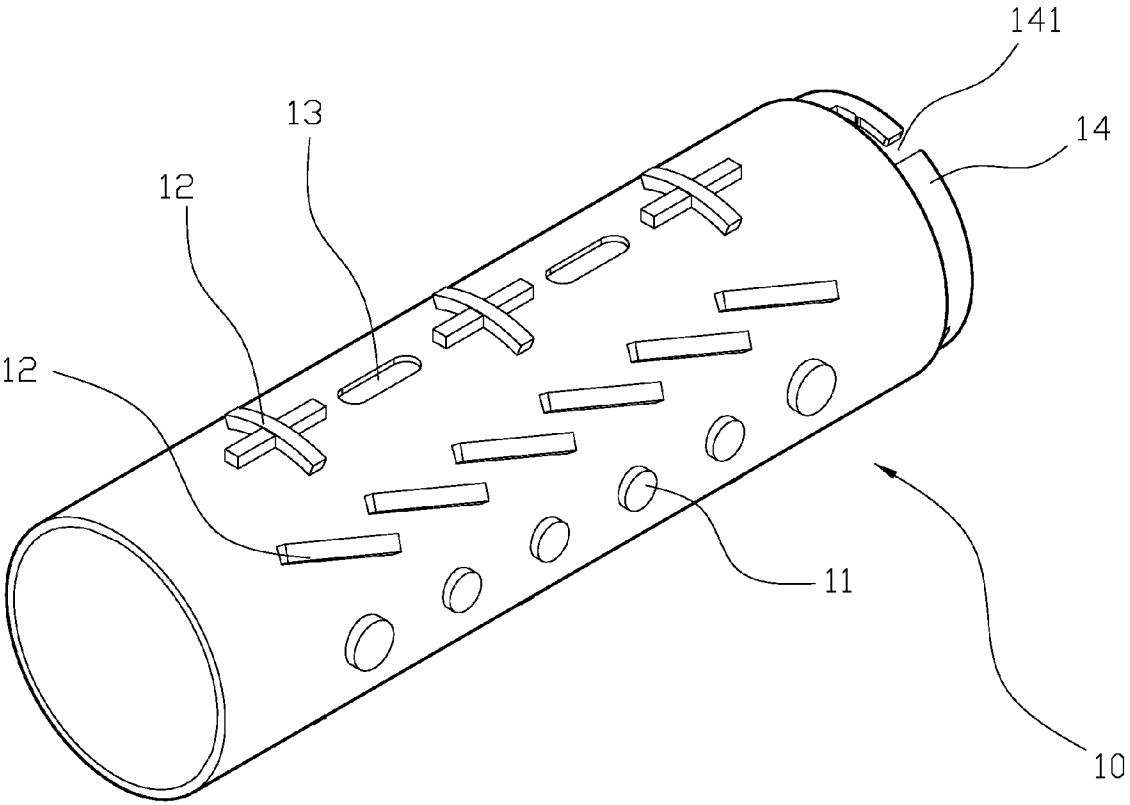
FIG. 4 illustrates a schematic view of the column body having the engaging ribs and the recessed slots in the present invention.
Figure 5:
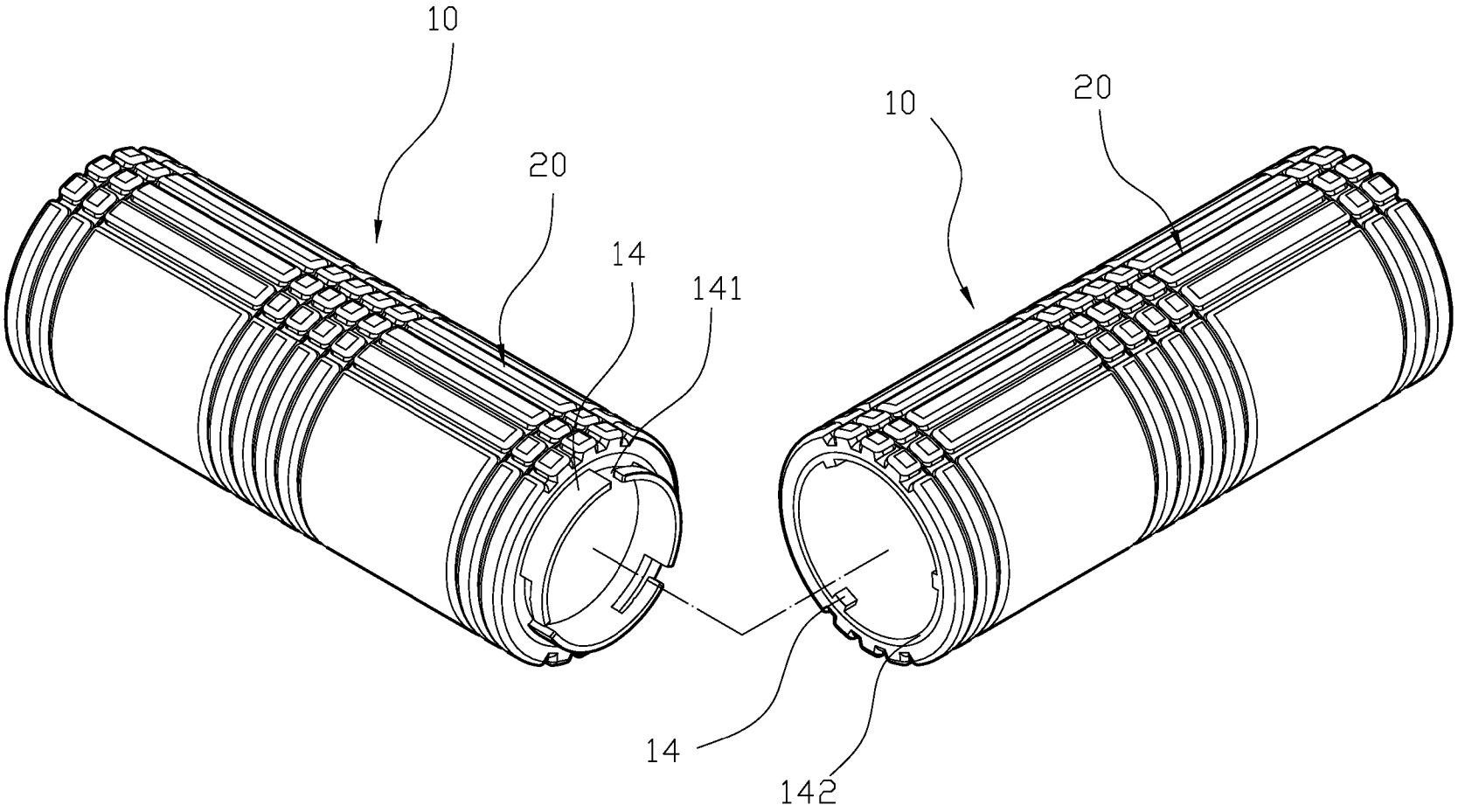
FIG. 5 illustrates an exploded view of another embodiment in the present invention.
Figure 6:
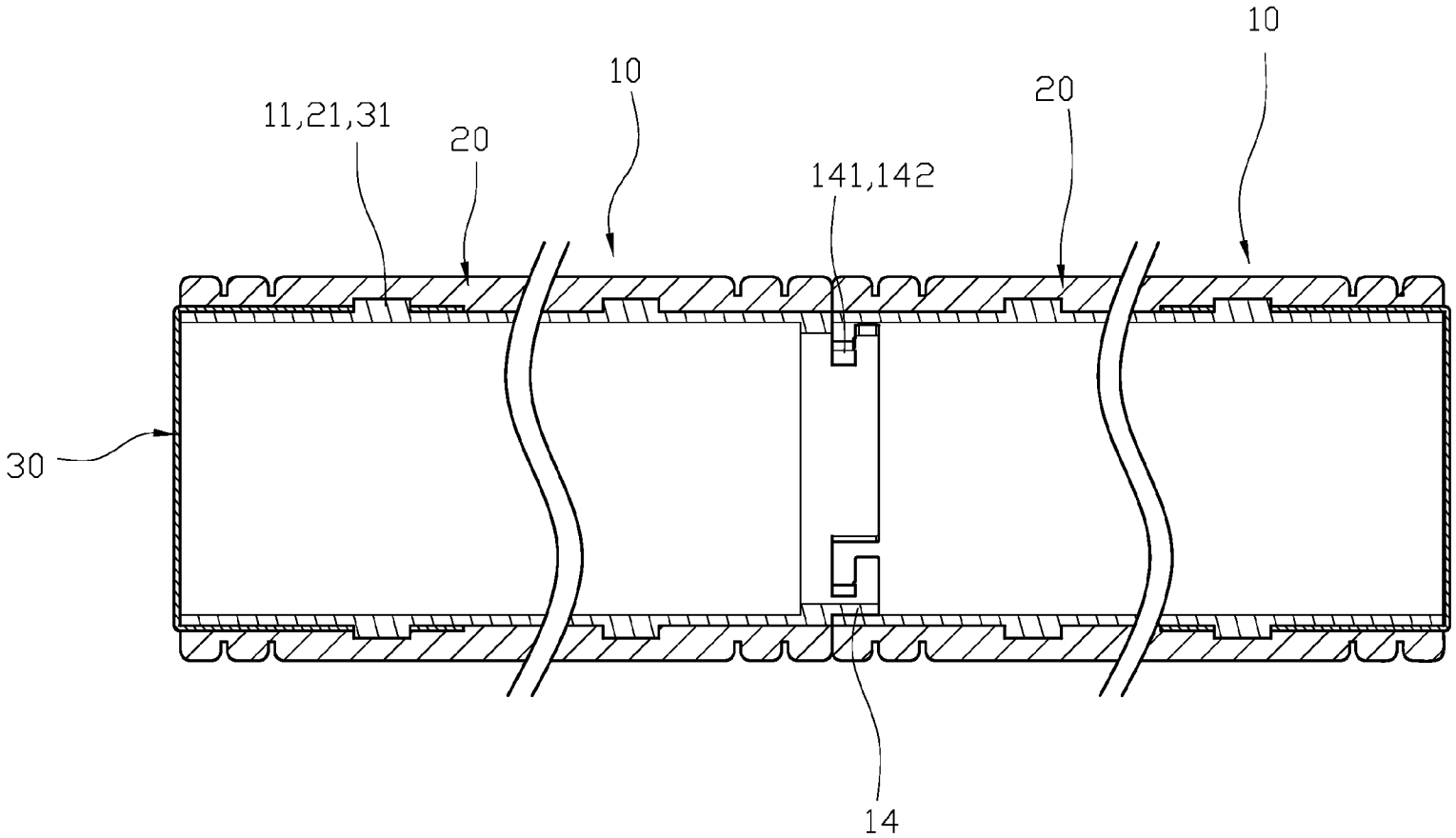
FIG. 6 illustrates a sectional view of another embodiment in the present invention.
Figure 7:
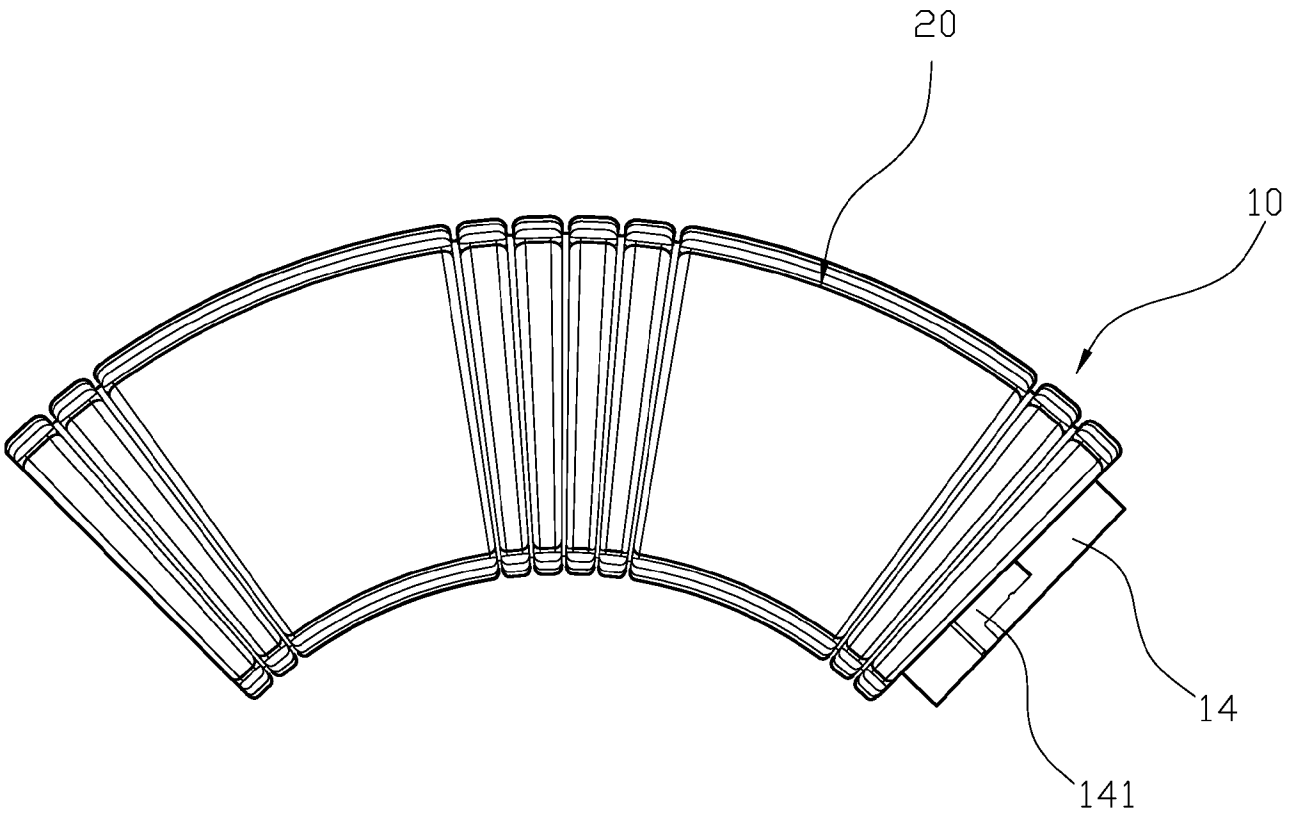
FIG. 7 illustrates a schematic view of a curved column body in the present invention.
Figure 8:
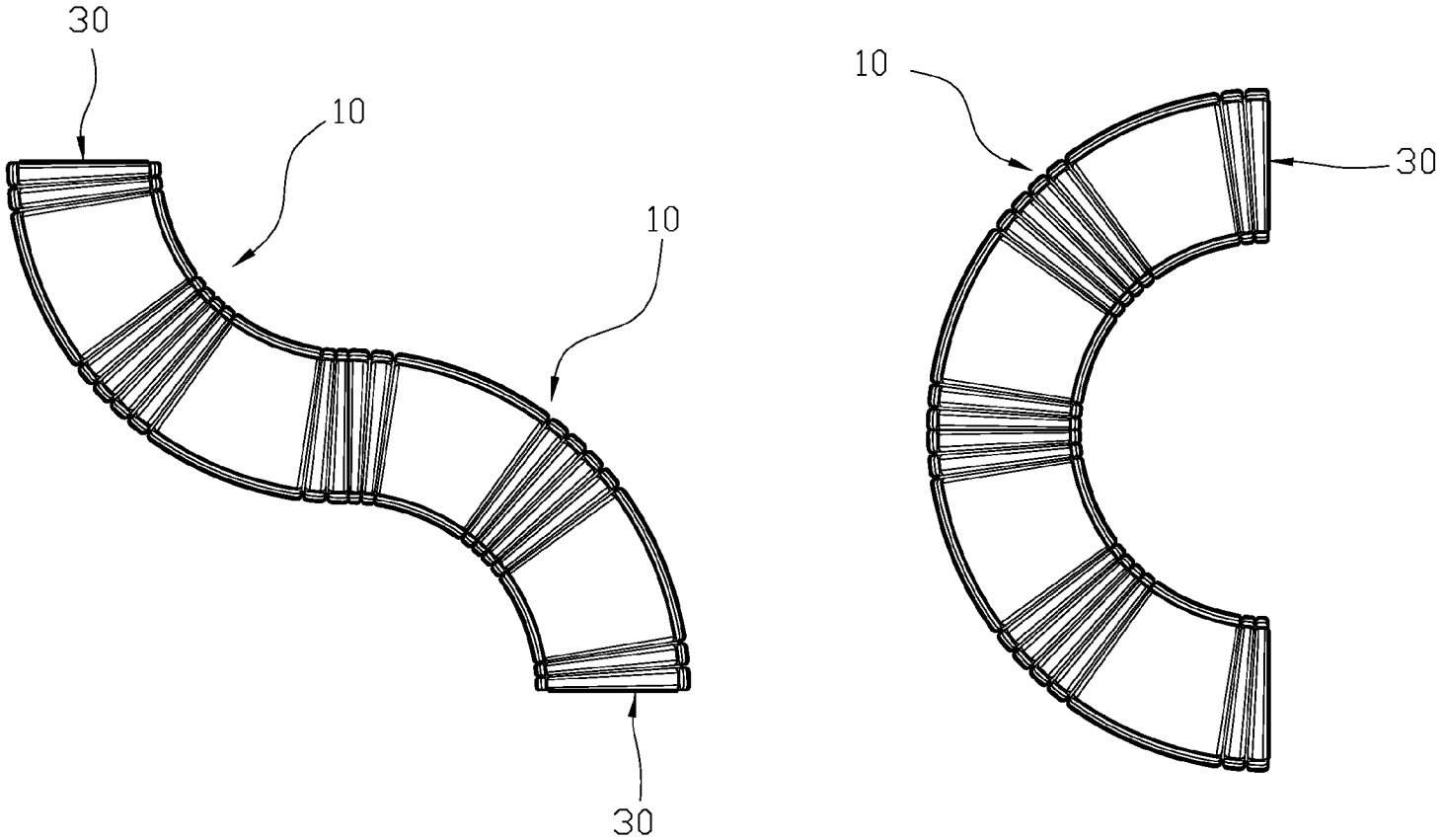
FIG. 8 illustrates a schematic view of an assembled curved column body in the present invention.
Figure 9:
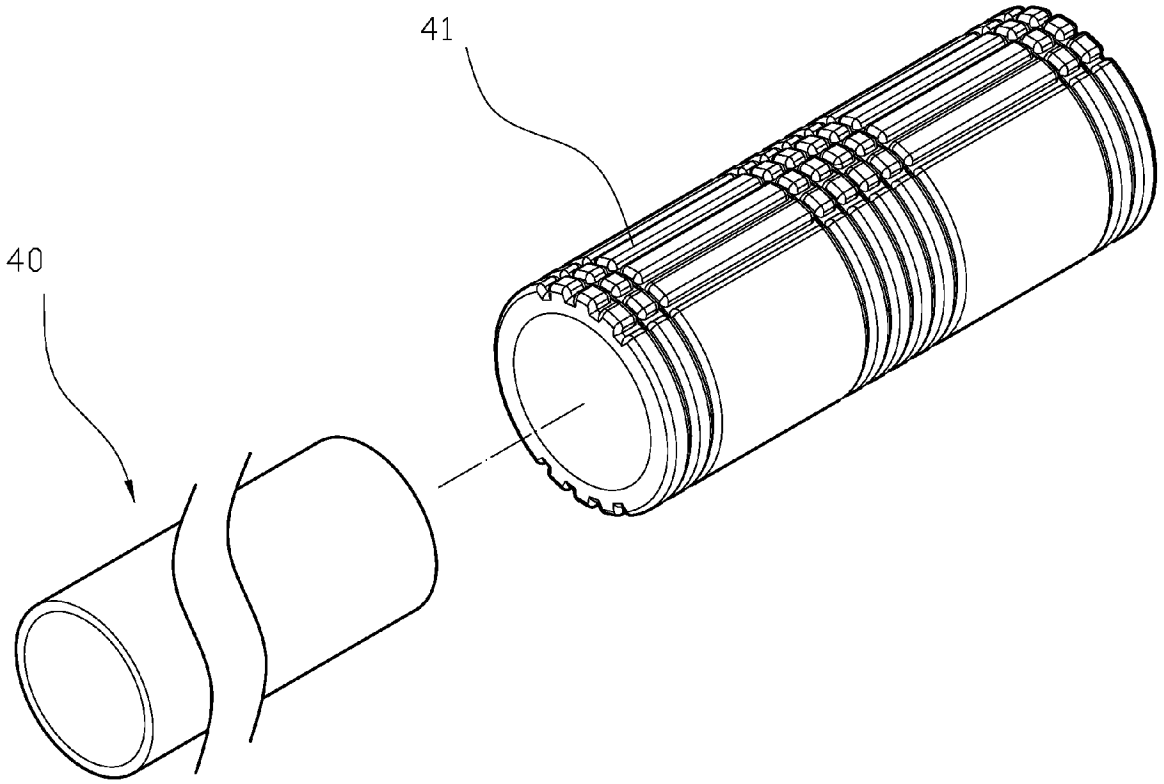
FIG.9 PRIOR ART
FIG. 9 illustrates an exploded view of a prior art.
Figure 10:
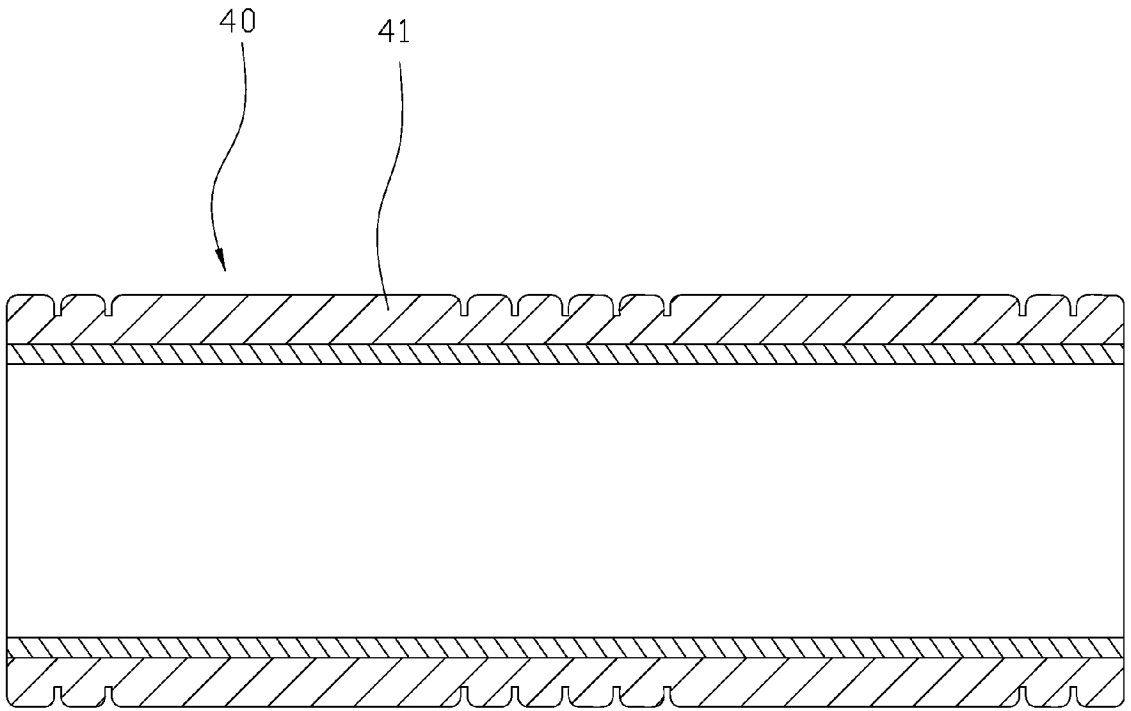
FIG.10 PRIOR ART
FIG. 10 illustrates a sectional view of a prior art.

In order to further understand the goal, characteristics and effect of the present invention, a number of embodiments along with the drawings are illustrated as following:

Referring to FIGS. 1 to 3, an exercise equipment may include a column body (10), which is hollow and has a plurality of engaging ribs (11) protruding at an outer surface thereof. A cover layer (20) covers the outer surface of the column body (10), and the cover layer (20) can be made by plastic injection or high-density foam. An inner surface of the cover layer (20) has recessed slots (21) corresponding to the engaging ribs (11), so that the cover layer (20) can tightly cover the outer surface of the column body (10) through the engagement of the engaging ribs (11) and the recessed slots (21) to avoid sliding and misalignment between the column body (10) and the cover layer (20). Furthermore, in addition to the engaging ribs (11), the outer surface of the column body (10) also has a plurality of auxiliary protruding ribs (12) and auxiliary recessed slots (13) (see FIG. 4) to form the structure of the exercise equipment in the present invention.

One lateral side of the column body (10) has a U-shaped handle (30), which has two through holes (31) on both sides thereof corresponding to the engaging ribs (11) of the column body (10), so that the handle (30) can be conjugated on the engaging ribs (11) at the outer surface of the column body (10) through the through holes (31). Furthermore, the handle (30) can be restricted between the column body (10) and the cover layer (20).

Referring to FIGS. 5 to 8 for another embodiment, one end of the column body (10) has a connecting portion (14) to connect different column bodies (10). The connecting portion (14) can protrude from an end portion of the first column body (10), and a plurality of L-shaped engaging slots (141) are formed at the end portion thereof; and the connecting portion (14) of the second column body (10) has a plurality of conjugating ribs (142) corresponding to the engaging slots (141). Thus, when the user wants to connect two column bodies (10), the two column bodies (10) are connected through the connecting portion (14). More specifically, the user first connects the engaging slots (141) and the conjugating ribs (142) of the connecting portion (14) and then twists the column bodies (10) to tighten it to finish the assembly process. Moreover, the column body (10) can be straight or curved to increase the variability thereof.

According to the embodiments discussed above, the present invention has the following advantages because: (i) the column body (10) has a plurality of engaging ribs (11) protruding at outer surface thereof and the cover layer (20) covers outer surface of the column body (10). Inner surface of the cover layer (20) has recessed slots (21) corresponding to the engaging ribs (11), so that the cover layer (20) can tightly cover the outer surface of the column body (10) through the engagement of the engaging ribs (11) and the recessed slots (21) to avoid sliding and misalignment between the column body (10) and the cover layer (20); and (ii) one end of the column body (10) has the connecting portion (14) to connect different column bodies (10) to increase the variability thereof.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. An exercise equipment comprising: a hollow column body having a plurality of engaging ribs protruding at an outer surface of the column body; a U-shaped handle having two through holes corresponding to two of the engaging ribs of the column body, so that the handle is able to conjugate the engaging ribs at the outer surface of the column body; and a cover layer covering said outer surface of the column body, wherein an inner surface of the cover layer has recessed slots corresponding to the engaging ribs, so that the cover layer is able to tightly cover the outer surface of the column body through the engagement of the engaging ribs and the recessed slots to avoid sliding and misalignment between the column body and the cover layer.

2. The exercise equipment of claim 1, wherein the cover layer is made by plastic injection.

3. The exercise equipment of claim 1, wherein the cover layer is made by high-density foams.

4. The exercise equipment of claim 1, wherein one end of the column body has a connecting portion to connect other column bodies.

5. The exercise equipment of claim 4, wherein the connecting portion protrudes from one end of a first column body, and a plurality of L-shaped engaging slots are formed at said end of the first column body; and the connecting portion of a second column body has a plurality of conjugating ribs corresponding to the engaging slots to connect the first and second column bodies.

6. The exercise equipment of claim 1, wherein the outer surface of the column body has a plurality of auxiliary protruding ribs.

7. The exercise equipment of claim 1, wherein the outer surface of the column body has a plurality of recessed slots.

8. The exercise equipment of claim 1, wherein the column body is straight.

9. The exercise equipment of claim 1, wherein the column body is curved.

* * * * *